US012797945B2

(12) United States Patent
Heimann

(10) Patent No.: US 12,797,945 B2
(45) Date of Patent: Nov. 17, 2026

(54) SEALING SYSTEM FOR A CONTINUOUS CASTING PLANT

(71) Applicant: SMS group GmbH, Düsseldorf (DE)

(72) Inventor: Jan Heimann, Düsseldorf (DE)

(73) Assignee: SMS group GmbH, Düsseldorf (DE)

( * ) Notice: Subject to any disclaimer, the term of this patent is extended or adjusted under 35 U.S.C. 154(b) by 51 days.

(21) Appl. No.: 18/709,019

(22) PCT Filed: Nov. 10, 2022

(86) PCT No.: PCT/EP2022/081394
§ 371 (c)(1),
(2) Date: May 9, 2024

(87) PCT Pub. No.: WO2023/099141
PCT Pub. Date: Jun. 8, 2023

(65) Prior Publication Data

US 2025/0001485 A1 Jan. 2, 2025

(30) Foreign Application Priority Data

Dec. 3, 2021 (DE) ..... 10 2021 213 770.9

(51) Int. Cl.
*B22D 11/08* (2006.01)

(52) U.S. Cl.
CPC ..... *B22D 11/088* (2013.01); *B22D 11/086* (2013.01)

(58) Field of Classification Search
CPC ..... B22D 11/08–088
USPC ..... 164/445–446
See application file for complete search history.

(56) References Cited

U.S. PATENT DOCUMENTS

| | | | | |
|---|---|---|---|---|
| 3,080,625 | A | 3/1963 | Pearson et al. | |
| 3,262,161 | A | 7/1966 | Andrzejak et al. | |
| 3,266,104 | A | 8/1966 | Foldessy et al. | |
| 3,448,789 | A | 6/1969 | Gallucci | |
| 3,643,731 | A | 2/1972 | Stull | |
| 4,719,960 | A | 1/1988 | Grothe et al. | |
| 5,335,716 | A * | 8/1994 | Takesue | B22D 11/168 164/483 |
| 5,456,307 | A | 10/1995 | Mouri | |
| 2010/0132909 | A1 | 6/2010 | Meier | |

FOREIGN PATENT DOCUMENTS

| | | | |
|---|---|---|---|
| CN | 2778432 | Y | 5/2006 |
| CN | 111299530 | A | 6/2020 |
| DE | 1918191 | A1 | 10/1970 |

(Continued)

OTHER PUBLICATIONS

Machine Translation of Abe et al(JP H0480639 U, published Jul. 14, 1992, cited in IDS filed Aug. 18, 2025). (Year: 1992).*

*Primary Examiner* — Keith Walker
*Assistant Examiner* — Jacky Yuen
(74) *Attorney, Agent, or Firm* — Smartpat PLC

(57) ABSTRACT

A sealing system (10) for use with a dummy bar head (1) of a continuous casting plant includes a plate-shaped, head element (12), to the edge region (13) of which a peripheral seal (14) is attached. It further includes an adapter element (18) made from metal which can be fastened with its bottom side (19) to a top end surface (2) of the dummy bar head (1). The head element (12) can be fastened to a top side (20) of the adapter element (18) and can be connected to the dummy bar head (1) as a result.

17 Claims, 5 Drawing Sheets

(56) References Cited

FOREIGN PATENT DOCUMENTS

| | | | | | |
|---|---|---|---|---|---|
| DE | 1608089 | A1 | | 11/1970 | |
| DE | 3123016 | A1 | | 3/1982 | |
| DE | 3230183 | A1 | | 4/1983 | |
| DE | 4401825 | A1 | | 8/1994 | |
| DE | 19643259 | C1 | | 4/1998 | |
| DE | 60004848 | T2 | | 7/2004 | |
| DE | 202005001310 | U | | 4/2005 | |
| DE | 202011109443 | U | | 1/2012 | |
| EP | 0114309 | A1 | * | 8/1984 | ..... B22D 11/088 |
| EP | 0234299 | A2 | | 9/1987 | |
| EP | 2127780 | A1 | | 12/2009 | |
| EP | 2588260 | B1 | | 5/2013 | |
| EP | 3797897 | A1 | | 3/2021 | |
| JP | S5542145 | A | | 3/1980 | |
| JP | H0480639 | U | | 7/1992 | |
| JP | H05285610 | A | | 11/1993 | |
| WO | 2012000830 | A1 | | 1/2012 | |

* cited by examiner

SEALING SYSTEM FOR A CONTINUOUS CASTING PLANT

CROSS-REFERENCE TO RELATED APPLICATION

This application is a national stage application, filed under 35 U.S.C. § 371, of International Patent Application PCT/EP2022/081394, filed on Nov. 10, 2022, which claims the benefit of German Patent Application DE 10 2021 213 770.9, filed on Dec. 3, 2021.

TECHNICAL FIELD

The disclosure relates to a sealing system for use with a dummy bar head of a continuous casting plant.

BACKGROUND

For the production of metallic products by means of continuous casting, it is known in the prior art to provide a seal at the start of the continuous casting process on a dummy bar head, with which a gap between the dummy bar head and the inner walls of a mold of a continuous casting plant is suitably sealed upon pouring. Corresponding sealing systems with such a seal are shown, for example, in EP 2 127 780 B1, DE 20 2005 001 310 U1, EP 0 234 299 B2, DE 44 01 825 A1 or DE 600 04 848 T2.

With the sealing systems according to the aforementioned prior art, an upper part of the system is always precisely adapted to a lower part in the form of the dummy bar head. This leads to the disadvantage that such an upper part, to which the seal is already attached or which serves to fix a seal located underneath, only ever fits on a specific shape of dummy bar head and is not suitable for use with other types of dummy bar heads. This can disadvantageously lead to increased production costs.

A sealing system is known from U.S. Pat. No. 3,266,104 A.

Further sealing systems are known from WO 2012/000830 A1, U.S. Pat. Nos. 3,080,625 A, 3,643,731 A, DE 16 08 089 A1, EP 3 797 897 A1 and CN 111 299 530 A. What these sealing systems have in common is that they each have a head element and an adapter element made of metal, the adapter element being able to be fastened with its underside to an upper end face of a dummy bar head.

SUMMARY

The present disclosure presents a sealing system that is suitable for use with a dummy bar head of a continuous casting plant, with which the start of the continuous casting process can be carried out more easily and cost-effectively and the associated work preparations can be carried out more quickly.

The sealing system is intended for use with a dummy bar head of a continuous casting plant and comprises a plate-shaped head element, to the edge region of which a peripheral seal is attached, and an adapter element made from metal, which can be fastened with its bottom side to an upper end surface of a dummy bar head, wherein the head element can be fastened to a top side of the adapter element and can thus be connected to the dummy bar head. Furthermore, this sealing system includes second positive-locking fastening means through which the head element and the adapter element can be connected to one another. What is characteristic of this sealing system is that the second fastening means comprise a plurality of through openings formed in the plate-shaped head element, the second fastening means also comprising a plurality of bolts which are attached to the top of the adapter element and pass through the through openings formed in the head element are pluggable, and that at a free end of a bolt or adjacent thereto an elongated hole is formed, through which a wedge can be driven, which rests on an upper side of the head element when it is plugged onto the bolt with its through openings.

For the sealing system, it is expedient if the head element is designed as a standardized component.

With regard to the adapter element, which is part of the sealing system, it can be emphasized separately at this point that this is thereby a separate component that can be arranged between the head element and an upper end surface of a dummy bar head. This ensures that the head element can be connected to/with the upper end surface of the dummy bar head with the aid of the adapter element. In this respect, it is advantageous if a top side of the adapter element is standardized in the same manner as the head element, such that an attachment of the head element to the top side of the adapter element is always possible.

By means of the adapter element, it is possible to connect a head element to possibly different dummy bar heads of a continuous casting plant. In particular in the event that the head element with the seal attached to it is designed as a standardized component, this has the advantage that a head element designed in this manner can be used for a large number of possibly different dummy bar heads. This ensures that the head element with the seal attached to it can be produced highly cost-effectively and can be provided for a large number of possibly different dummy bar heads, specifically, as explained, thanks to the characteristic adapter element, with which a connection of the head element to a dummy bar head can be realized.

In an advantageous further development, the head element with a seal attached to it, which can be made from plastic or has a plastic component, is designed as a "disposable article." Within the context of the present disclosure, this means that such a head element, when it comes into contact with the molten steel/metal and the cast metal strand/continuous casting product formed therefrom at the start of a continuous casting process, then enters into an initially permanent connection with the hot strip and is separated from this product by cutting only after sufficient solidification of an intermediate or end product formed therefrom, for example a slab.

In accordance with an advantageous further development, an attachment of the adapter element to the dummy bar head is ensured by the fact that the bottom side of the adapter element is adapted to the upper end surface of the dummy bar head and can be fastened to the upper end surface of the dummy bar head by first fastening means. Thereby, it is expedient if the first fastening means are designed to be positive-locking, as a result of which a high level of operational reliability for the start of the continuous casting process is achieved.

In an advantageous further development, the aforementioned first fastening means can be provided with at least one connecting bar, which has a bulge or hook at its free end, and at least one recess. Thereby, the bulge/hook on the one hand and the recess on the other hand can be brought into engagement with one another in order to achieve a positive-locking connection between the adapter element and the dummy bar head. For example, the connecting bar can be provided as a projecting/protruding part on a bottom side of the adapter element, wherein the bulge or hook is formed on a free end of this. Furthermore, the recess can be formed in the dummy bar head, preferably at or adjacent to its upper end surface, and thereby can comprise a widened region. Thus, the recess in the dummy bar head can be formed adjacent to its upper end surface and open into this end surface. In this connection, it is expedient if the bulge and the widened region of the recess are designed to complement one another.

In order to achieve an operationally reliable connection between the adapter element and the dummy bar head, it is expedient if a plurality of connecting bars are attached to the bottom side of the adapter element, which can then be hooked into the recesses of the dummy bar head in a positive-locking manner. For example, three, four or possibly >4 such connecting bars can be provided on the bottom side of the adapter element, with a correspondingly adapted number of recesses in the dummy bar head adjacent to its upper end surface.

In accordance with an advantageous further development, with the aforementioned first fastening means, it can be provided that a recess has a bottleneck-like narrow section that, starting from the upper end surface of the dummy bar head, leads into the widened region of the recess. Complementary to the bottleneck-like section of the recess, the connecting bar comprises a slender neck region, which is located between the mushroom-like bulge of the connecting bar and the bottom side of the adapter element. In any event, a secure positive lock between the adapter element and the dummy bar head in the transport direction of the dummy bar head is ensured if the mushroom-shaped bulge of the connecting bar is engaged in the widened region of the recess.

In an advantageous further development, it is expedient if the recess is open on at least one side surface of the dummy bar head, such that the connecting bar can be introduced into the recess with its bulge (or alternatively: with its hook) from this side surface. In this manner, on the one hand, a particularly tool-free connection of the adapter element to/on the upper end surface of the dummy bar head is possible, as well as a separation of the adapter element from the dummy bar head when the continuous casting process is advanced by exerting a force (tensile or compressive force) transversely to the transport direction to the adapter element of the dummy bar head.

In an advantageous further development, it is provided for the head element and the adapter element to in each case have a rectangular cross-section in a plane running orthogonally to the transport direction of the dummy bar head head, which has a long side and a short side. Such a rectangular cross-section is characterized by the fact that its long side is multiple times larger than the short side. In any event, it should be emphasized in this connection that both the head element and the adapter element with their cross-section in the plane orthogonal to the transport direction of the dummy bar head are in each case adapted to a cross-section of a mold of a continuous casting plant. With respect to the aforementioned length ratio, according to which the long side of the rectangular cross-section is multiple times larger than the short side, it should be pointed out that this is typical for the continuous casting of slabs.

In an advantageous further development, it is provided that a short side of the rectangular cross-section of the adapter element/of the head element has a length of at least 100 mm, preferably of 120 mm, more preferably of more than 150 mm. In this respect, it is to be understood that the thickness of a later solidified slab is influenced by the length of the short side of the rectangular cross-section/that the length of this short side corresponds to the thickness of a solidified slab.

By means of the second fastening means the head element and the adapter element can be connected to one another. In the same manner as the first fastening means, it is also expedient for these second fastening means to function according to the principle of positive locking.

With respect to the aforementioned second fastening means it is provided that a plurality of through openings are formed in the head element, preferably at the same distance from one another. Accordingly, a plurality of bolts are attached to the top side of the adapter element, preferably also at the same distance from one another and in particular adapted to the distance of the through openings. In other words, a plurality of bolts can be attached to the top side of the adapter element, wherein the spacing of these bolts relative to one another is selected in the same manner as a spacing of the through openings formed in the head element relative to one another. This makes it possible for the head element with its through openings to be plugged from above onto the bolts attached to the top side of the adapter element.

With regard to the aforementioned second fastening means it is provided that an elongated hole is formed in each of the bolts, which are attached to the top side of the adapter element as explained. A wedge is provided in conjunction with such an elongated hole, which wedge can be inserted into this elongated hole. Thereby, such a wedge thereby fulfills the function that, after the head element has been plugged from above onto the bolts attached to the top of the adapter element with its through openings formed thereon, a clamping of the head element against/with its top side is possible by driving the wedge into the elongated hole of a bolt. The only tool that may be required is a hammer to drive the wedge into the elongated hole.

A method for producing a metallic product by continuous casting is also provided, with which a sealing system with the aforementioned features is used. At the start of such a method, the molten metal undergoes sufficient cooling by contact with the top side of the head element and the elevation(s) provided there when it is filled into the mold of a continuous casting plant, such that this start of the method can be carried out without cooling scrap.

The sealing system provides several advantages, including one or more of the following:

- Reduction of damage caused by cooling scrap, because the risk of damage to the downstream parts of a supporting strand guide of a continuous casting system caused by cooling scrap previously used for sealing is eliminated.
- Reduction of the risk of breakthroughs upon pouring.
- Process shortening, in particular with respect to work preparation for sealing the mold at its lower opening prior to the start (or continuation) of a continuous casting process.
- Simplification of the necessary sealing of the mold at its lower opening, due to a reduced number of process steps.
- The duration of the preparation steps for pouring and the time employees spend at the mold is minimized.
- Simplification upon pouring in continuous slab casting including sealing of the mold. And/or:
- Acceleration of the preparation for pouring and protection against breakthrough, by minimizing the duration of the preparation steps for pouring and the time the employees stay at the mold.

Examples of embodiments of the invention are described in detail below with reference to a schematically simplified drawing.

DETAILED DESCRIPTION

Figure 1:
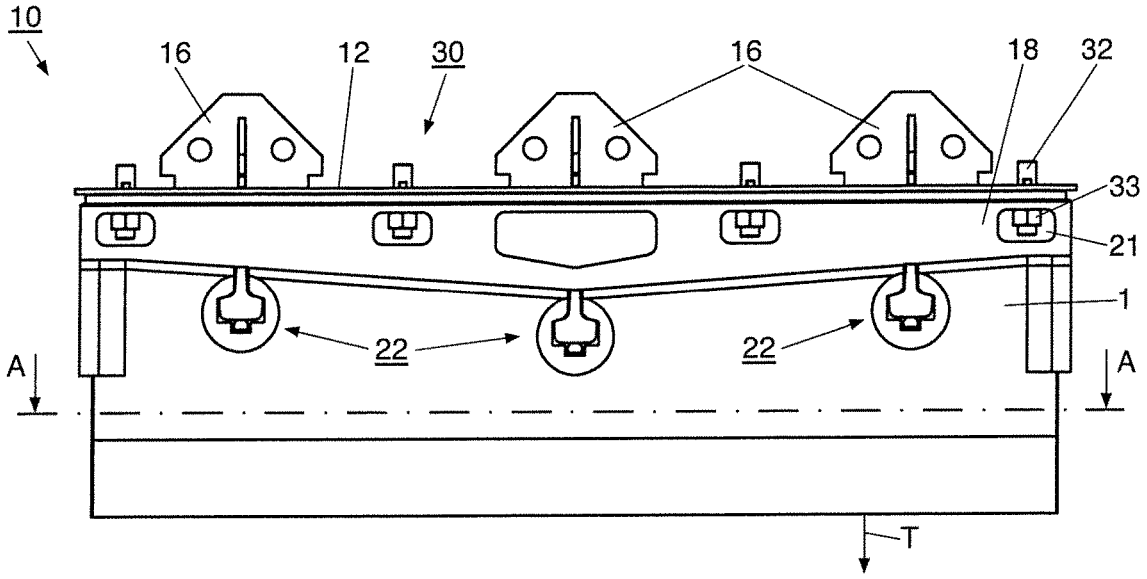
FIG. 1 shows a side view of a sealing system in the mounted state.

With reference to FIGS. 1 to 9, preferred embodiments for a sealing system 10 intended for use with a dummy bar head of a continuous casting plant are shown and explained below. Identical features in the drawing are in each case marked with the same reference signs. At this point, it is separately pointed out that the drawing is only simplified and in particular shown without scale.

FIG. 1 shows a side view of the sealing system 10 if it is mounted on a dummy bar head 1.

The sealing system 10 consists of a plurality of components and comprises in detail a head element 12 and an adapter element 18.

The head element 12 and the adapter element 18 are preferably made from metal, for example steel.

Figure 4:
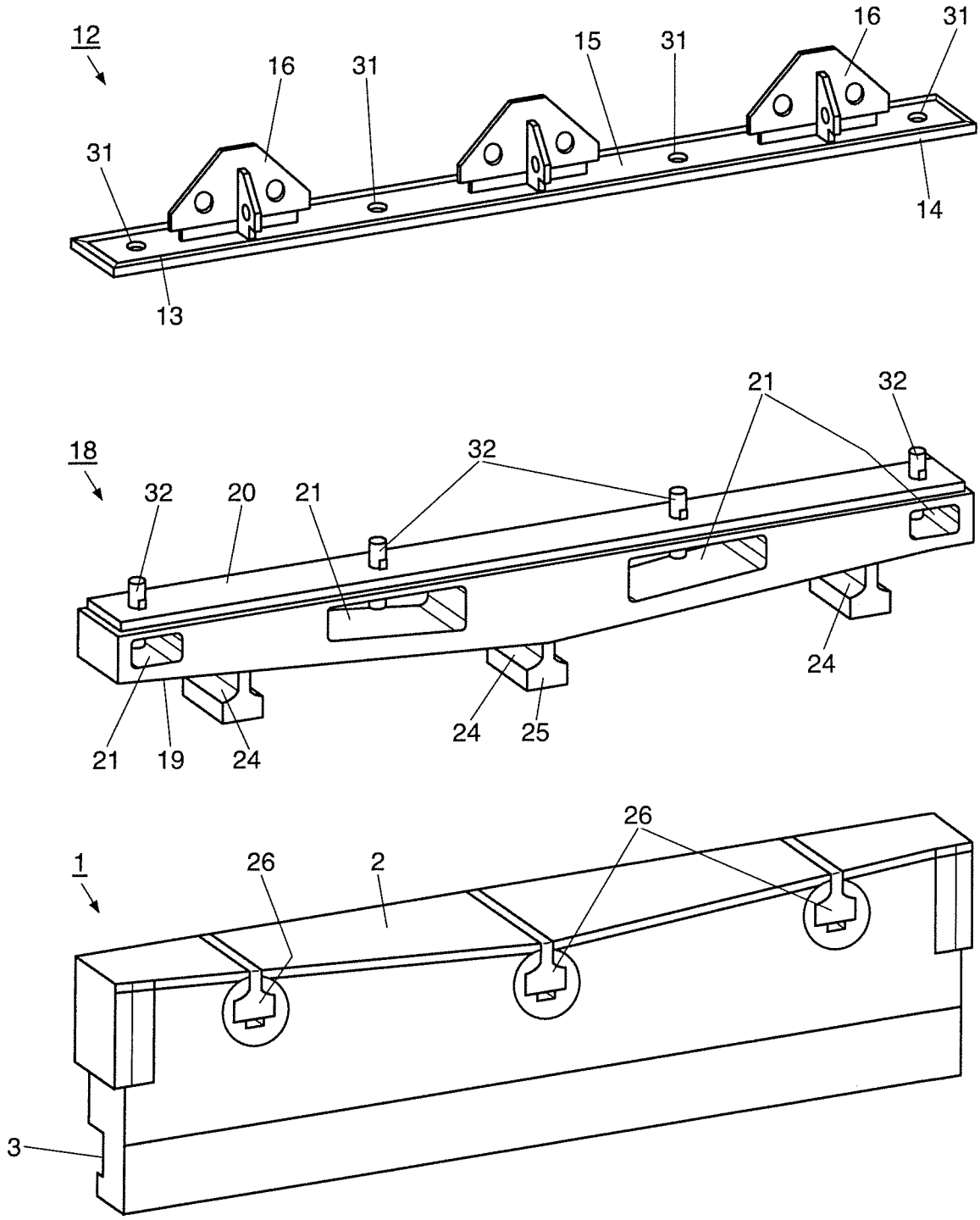
FIG. 4 shows a perspective view of individual parts of the sealing system of FIG. 1, which comprises a head element and an adapter element.

In FIG. 4, the individual components of the sealing system 10 are shown in perspective in an exploded view.

The adapter element 18 can be fastened with its bottom side 19 to/on an upper end surface 2 of the dummy bar head 1 (see FIG. 4, bottom representation). For this purpose, the sealing system comprises a first fastening means 22, which are explained separately below.

The head element 12 can be placed on a top side 20 of the adapter element 18 from above and suitably fastened there by means of second fastening means 30.

The head element 12 in accordance with the embodiment shown here is designed to be plate-shaped. This has the advantage that the head element has a light weight and can be produced cost-effectively.

A peripheral seal 14 is attached along an edge region 13 of the head element 12. This seal 14 can be made from plastic and is molded onto/suitably fastened to the edge region 13 of the head element 12. In this respect, the head element 12 and the seal 14 attached to it form an assembly.

Figure 9:
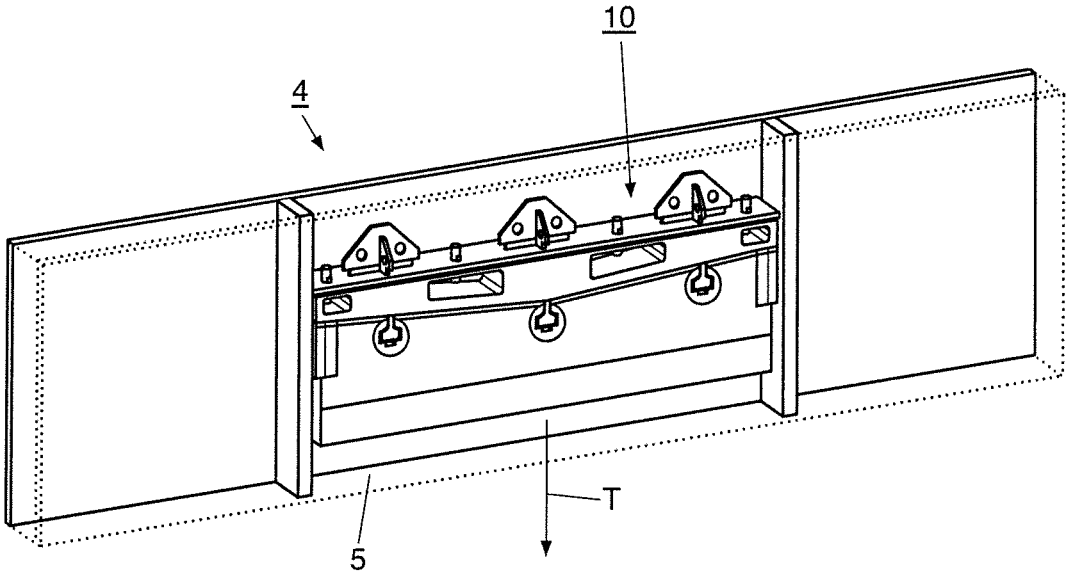
FIG. 9 shows a perspective view of the mounted sealing system of FIG. 1 if it is introduced into a mold of a continuous casting plant.

With regard to the seal 14, it should be pointed out at this point that its external dimensions are slightly larger than the cross-section of a mold of a continuous casting plant in a plane orthogonal to the transport direction of the dummy bar head. Reference is made to FIG. 9, in which a mold 4 is shown in simplified form, wherein the sealing system 10 is arranged within this mold 4 and a lower opening 5 of the mold is sealed by means of the seal 14.

Figure 2:
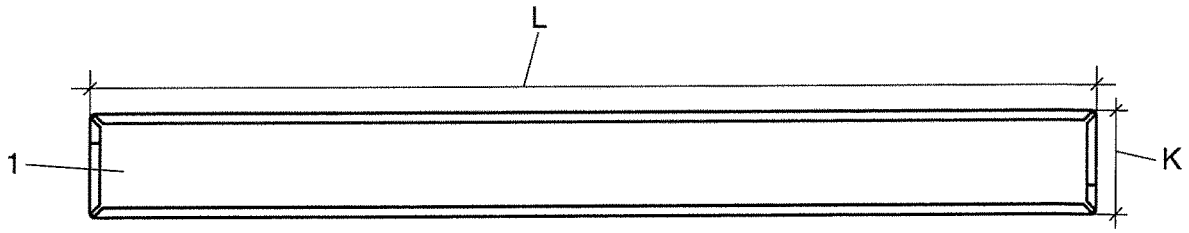
FIG. 2 shows a cross-sectional view along line A-A of FIG. 1.

FIG. 2 shows a cross-section through the dummy bar head 1 along line A-A of FIG. 1 and illustrates that this cross-section is designed to be rectangular. The proportions of this are selected in such a manner that a long side L is multiple times larger than a short side K of this cross-section.

With regard to the cross-section of the dummy bar head 1 shown in FIG. 2, it should be pointed out that the cross-section of the adapter element 18 is selected in the same manner and therefore has the same proportions. Similarly, the external dimensions of the head element 12, shown in the top view of FIG. 3, can correspond to the cross-section of FIG. 2.

In any event, the proportions of the head element 12 and the adapter element 18 are selected in such a manner that they are in each case adapted to a cross-section of the mold 4 of a continuous casting plant (not shown) (see FIG. 9) and can thus be introduced into the mold 4.

A plurality of elevations 16 are attached to a top side 15 of the head element 12. These elevations 16 are designed in such a manner that they have the largest possible contact surface. With the embodiment example shown here, these elevations can each have a multi-part structure, which is designed to be cross-shaped in top view (see FIG. 3).

The elevations 16 serve the purpose of coming into contact with molten steel at the start of a continuous casting process, which is filled into the mold 4 of a continuous casting plant from above. Thereby, the elevations 16 are flowed around by the molten steel, with the result that a hot strand formed from the molten steel bonds firmly with the head element 12 on its top side 15 and the elevations 16 attached there. Due to the large contact surfaces of the elevations 16, a reduction in the temperature of the molten steel is advantageously achieved when it comes into contact with the molten steel, which contributes to its solidification.

The first fastening means 22, with which a fastening of the adapter element 18 to the upper end surface 2 of the dummy bar head 1 is achieved, are explained below.

The first fastening means 22 comprise at least one connecting bar 24, which has a mushroom-shaped bulge 25 at its free end, and at least one recess 26 with a widened region 27.

As shown in the central representation of FIG. 4, three connecting bars 24 are attached to a bottom side 19 of the adapter element 18, each of which projects downwards from the bottom side 19. With regard to the design of these connecting bars 24, reference may also be made to the side view in FIG. 6: This shows that a connecting bar comprises a mushroom-shaped bulge 25 at its free end.

Figure 7:
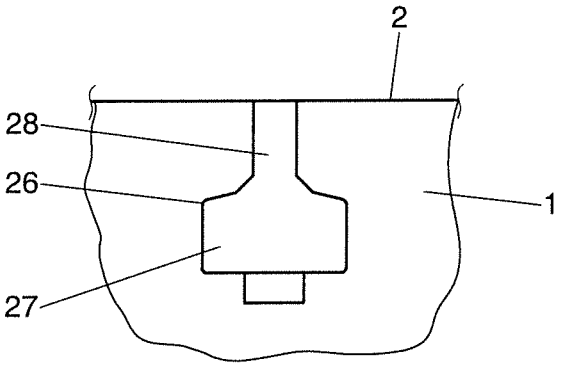
FIG. 7 shows a side view of a recess formed in a dummy bar head adjacent to its upper end surface.

According to the lower representation of FIG. 4, the recess 26 in the dummy bar head 1 is formed adjacent to its upper end surface 2, specifically in such a manner that this recess 26 opens into this end surface 2. As also illustrated in the view of FIG. 7, the recess 26 has a widened region 27. Between this widened region 27 and the upper end surface 2 of the dummy bar head 2, the recess 26 comprises a narrow bottleneck-like section 28 that, starting from the upper end surface 2 of the dummy bar head 1, leads into the widened region 27 of the recess 26.

Figure 5:
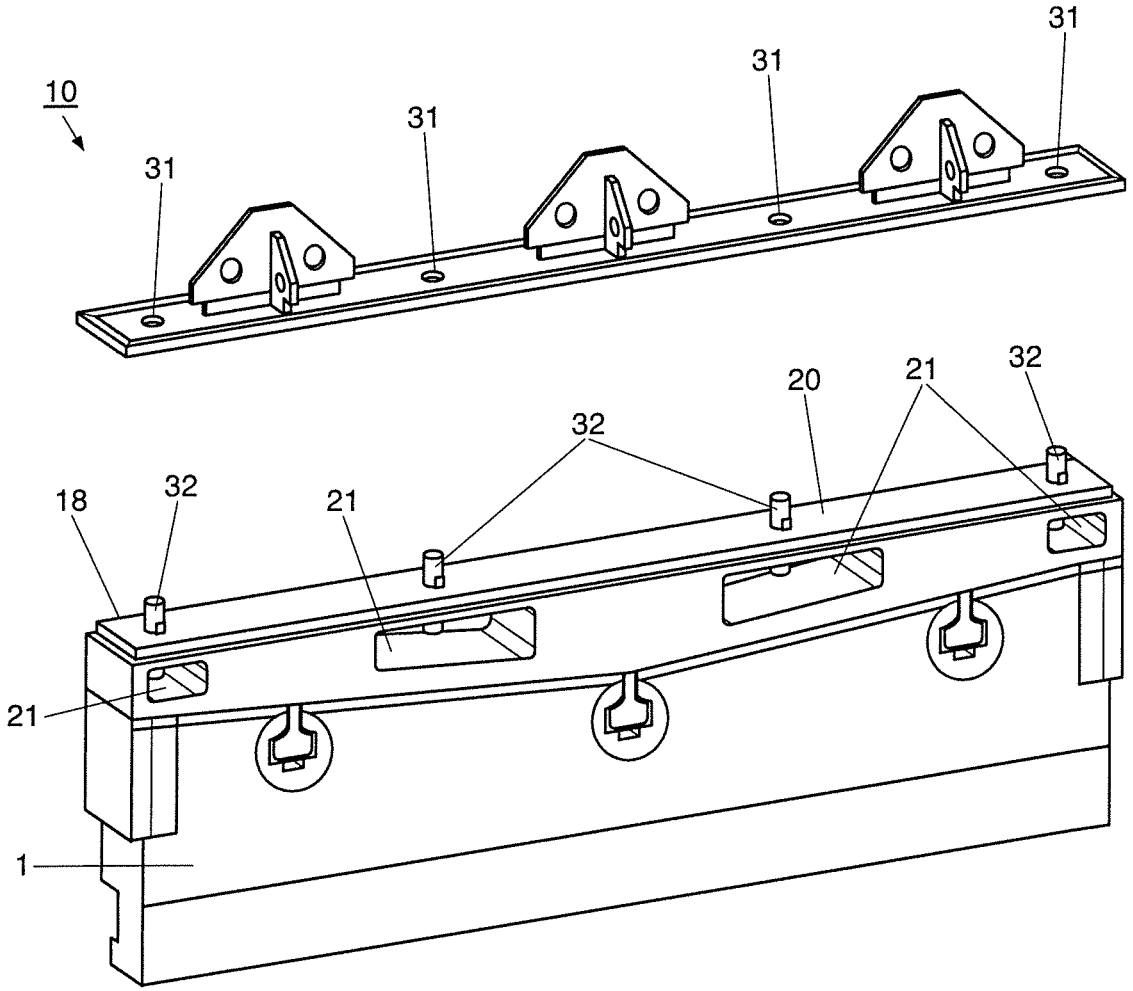
FIG. 5 shows a perspective view of the sealing system of FIG. 4 if its adapter element is already connected to a dummy bar head.

Regarding the recess 26, it should also be pointed out that it is open on at least one side surface of the dummy bar head 1 (shown in the foreground in the lower representation of FIG. 4). As a result, it is possible to insert the connecting bar 24 with its bulge 25 laterally into the recess 26 from this open side surface. FIG. 5 shows a mounted state of the adapter element 18 if the connecting bars 24, which are attached to the bottom side 19 of the adapter element 18, have all been introduced into the assigned recesses 26 of the dummy bar head 1. In this respect, it should be emphasized that the bulge 25 of the connecting bar 24 and the widened region 27 of the recess 26 are designed to complement one another, specifically in such a manner that the connecting bar 24 with its bulge 25 can be introduced into the recess 26 and its widened region 27 without jamming. Viewed in the transport direction of the dummy bar head 1, which is symbolized by an arrow "T" in FIG. 1 and FIG. 9, this results in a positive-locking connection between the adapter element 18 and the dummy bar head 1 at its upper end surface 2 if the connecting bars 24 are inserted into the recesses 26, as explained.

The second fastening means 30, with which fastening of the head element 12 to/on the top side 20 of the adapter element 18 is achieved, are explained below.

The second fastening means 30 comprise a plurality of through openings 31, which are formed in the head element 12, which is designed to be particularly plate-shaped. These through openings 31 are shown, for example, in the upper representation in FIG. 4 and in the same manner in FIG. 5.

Furthermore, with the embodiment shown here, the second fastening means 30 also comprise a plurality of bolts 32, which are attached to the top side 20 of the adapter element 18 (see FIG. 4 & FIG. 5).

In order to attach the bolts 32 to the top side 20 of the adapter element 18, it can be provided that through openings (not shown), into which the bolts 32 are inserted, are formed in the top side 20 for this purpose. Aligned with these through openings, "windows"/apertures 21 are formed in the adapter element 18, as can be seen in the middle representation of FIG. 4 and also in FIG. 5. In any event, the bolts 32 are mounted in the said through opening on the top side 20 of the adapter element 18 in such a manner that they project with their lower free ends into the assigned windows 21 and can be suitably fixed there by means of a nut 33 (see FIG. 1).

Figure 8:
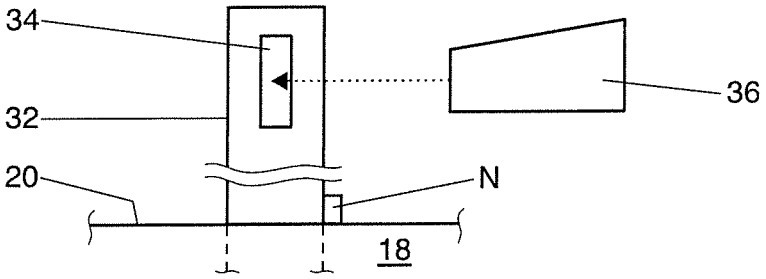
FIG. 8 shows a side view of a bolt attached to a top side of the adapter element.

With reference to FIG. 8, further details of a bolt 32 are shown and explained:

At least one cam N or the like is fastened or molded to the outer peripheral surface of a bolt 32 in the region above the top side 20 of the adapter element 18. The cam N serves to ensure that a bolt 32, if it is introduced into an assigned through opening in the top side 10 of the adapter element 18, is seated with this cam N on the top side 20 of the adapter element 18 and thus reaches a defined end position, in which it is then possible to fix the bolt 32 by means of the nut 33 at its lower free end, as explained. In connection with such a fastening of the bolts 32 to the top side 20 of the adapter element 18, said windows 21 formed in the adapter element 18 adjacent to the top side 18 thereof are helpful.

With regard to the embodiment of an adapter element 18 as shown in FIGS. 4 and 5, it should be pointed out that thereby the shape of the windows 21 differs slightly from the embodiment shown in FIG. 1. Nevertheless, this does not change the mode of operation of these windows 21, through which the ability to mount the bolts 32 on the top side 20 of the adapter element 18 is possible.

The bolt 32 has an elongated hole 34 adjacent to an upper free end thereof, into which a wedge 36 can be inserted. This serves to fasten the head element 12 to the adapter element 18, as explained below:

After the bolts 32 have been attached to the top side 20 of the adapter element 18 as explained, the head element 12 can be placed on the top side 20 of the adapter element 18 from above, wherein the bolts 32 are inserted through the through openings 31 formed in the head element 12. In its position placed on the top side 20 of the adapter element 18, the plate-shaped head element 12 is located below the elongated holes 34, which are formed in the respective bolts 32. Following this, wedges 36 are driven through the elongated holes 34 of the respective bolts 32, such that the wedges 36 rest on the top side 15 of the head element (12). In this manner, a positive-locking clamping of the head element 12 to/with the top side 20 of the adapter element 18 can be achieved, wherein, at most a hammer or the like may be required for this purpose.

Figure 3:
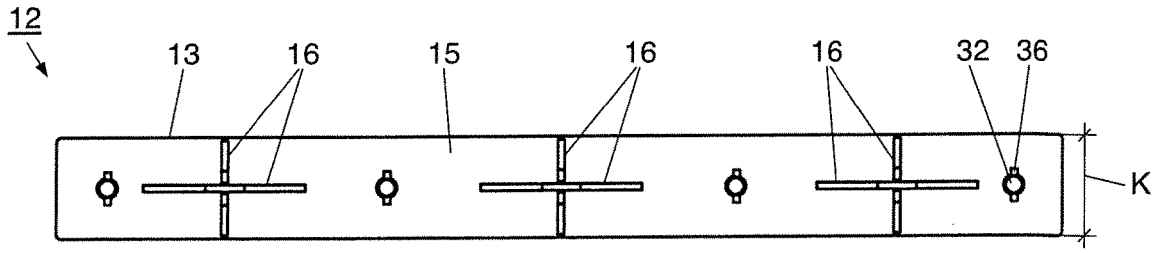
FIG. 3 shows a top view (from above) of the sealing system of FIG. 1.

The mounted position of the head element 12, if it is attached to the top side 20 of the adapter element 18 as explained and clamped thereon using the wedges 36, is shown in the views of FIG. 1 and FIG. 3.

As already explained elsewhere, it is expedient for the head element 12 if it is designed as a standardized component. With the aid of the adapter element 18, it is then possible to connect such a standardized head element 12 to different dummy bar heads 1 if necessary.

The sealing system functions as follows:

At the start of a continuous casting process, an adapter element 18 is initially fitted with the bolts 32 on its top side 20.

The adapter element 18 is then connected in a positive-locking manner to the upper end surface 2 of the dummy bar head 1 by inserting the connecting bars 24 with the bulges 25 formed on them from the side into the assigned recesses 26 of the dummy bar head 1 (see FIG. 5).

The head element 12 (with the seal 14 already attached to it) is then placed on the top side 20 of the adapter element 18 as explained, wherein the bolts 32 pass through the through openings 31 of the head element 12. The head element 12 is then clamped on/to the top side 20 of the adapter element 18 using the wedges 36, which are driven into the elongated holes 34 of the respective bolts 32.

As soon as the head element 12 has been connected to the dummy bar head 1 using the adapter element 18, the sealing system 10 thus formed can be introduced into the mold 4 of a continuous casting plant, as illustrated in FIG. 9. In the representation in FIG. 9, a plate located in the foreground is only indicated with phantom lines for simplification, such that the sealing system 10 located behind it can be recognized.

The dummy bar head 1 is then positioned in the mold 4 in preparation of pouring in such a manner that the lower opening 5 is suitably closed/sealed by means of the seal 14. As a result, it is achieved with the present sealing system that a liquid molten metal, for example liquid steel, cannot flow downwards out of the mold 4 upon actual pouring.

Due to the contact of the liquid molten metal/steel with the elevations 16, which as explained are attached to the top side 15 of the head element 12 and have a relatively large contact surface, it is achieved that the molten metal/steel undergoes a temperature reduction, which contributes to the desired solidification of the molten metal. Thus, the use of cooling scrap can be dispensed with upon pouring/at the start of a continuous casting process.

Pulling the dummy bar head 1 out of the mold 4 in the transport direction T is achieved by means (not shown), for example in the form of a chain or the like, which is brought into engagement with the undercut/groove 4 formed at a lower end of the dummy bar head 1.

At an advanced stage of the continuous casting process, with which a metal strand/hot strip has already formed from the solidified molten metal, the dummy bar head 1 can be detached from the adapter element 18 by exerting a force perpendicular/transverse to the transport direction T on it. As a result, the connecting bars 24 are then driven out of the recesses 26, as a result of which the dummy bar head 1 and the adapter element 18 are separated from one another and thus at least the dummy bar head 1 can be inserted once again.

The adapter element 18 can also be used repeatedly for a new continuous casting process. For this purpose, a section of the solidified hot strand that has connected to the head element 12 can be severed, wherein, subsequently, the nuts 21 can be detached from the lower ends of the bolts 32, such that the adapter element 18 can be removed from the bolts 32. When the adapter element 18 is used again, only new bolts 32 need to be attached to its top side 20. In contrast, the "old" bolts 32 remain in the solidified region of the hot strand and then form "scrap" together with the head element 12.

Figure 6:
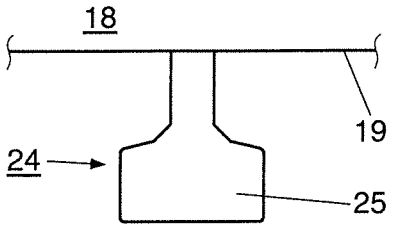
FIG. 6 shows a side view of a connecting bar attached to the bottom side of an adapter element.

Finally, it should be pointed out that the embodiment of the first fastening means 22 shown in FIG. 4, FIG. 6 and FIG. 7, specifically each in the form of the connecting bar 24 with the mushroom-shaped bulge 25 and the recess 26 with the widened region 27, is merely a possible embodiment of these first fastening means 22. Deviating from this, but with the same mode of operation, these positive-locking first fastening means 22 can also comprise a hook (not shown) or the like (preferably at the free end of the connecting bar 24), which can be brought into engagement with a part/section on the dummy bar head 1, for example in the form of a recess or an undercut, in order thereby to realize a positive-locking connection between the adapter element and the dummy bar head, which can also be released again if necessary.

LIST OF REFERENCE SIGNS

1 Dummy bar head
2 Upper end surface (of the dummy bar head 1)
3 Undercut
4 Mold
5 Lower opening (of the mold 3)
10 Sealing system
12 Head element
13 Edge region (of the head element 12)
14 Seal
15 Top side (of the head element 12)
16 Elevation(s) (on the top 15 of the head element 12)
18 Adapter element
19 Bottom side (of the adapter element 18)
20 Top side (of the adapter element 18)
21 Window/aperture (in the adapter element 18)
22 First fastening means
24 Connecting bar
25 Bulge
26 Recess
27 Widened region (of the recess 26)
28 Bottleneck-like narrow section (of the recess 26)
30 Second fastening means
31 Through opening
32 Bolt
33 Nut
34 Elongated hole
36 Wedge
L Long side
K Short side
T Transport direction (of the dummy bar head 1)

The invention claimed is:

1. A sealing system (10) for use with a dummy bar head (1) of a continuous casting plant, comprising:
- a head element (12), the head element (12) being plate-shaped;
- a peripheral seal (14) attached to an edge region (13) of the head element (12);
- an adapter element (18) made from metal, having a bottom side (19) which can be fastened to an upper end surface (2) of the dummy bar head (1),
  - wherein the head element (12) can be fastened to a top side (20) of the adapter element (18) and can be connected to the dummy bar head (1) as a result; and
- a positive-locking connection (30), by which the head element (12) and the adapter element (18) can be connected to one another, including
  - a plurality of through openings (31), which are formed in the head element (12),
  - a plurality of bolts (32), which are attached to the top side (20) of the adapter element (18) and can be plugged through the through openings (31) formed in the head element (12), and
  - an elongated hole (34) formed at a free end of each bolt (32) or adjacent thereto, through which a wedge (36) can be driven, the wedge (36) being seated on a top side (15) of the head element (12) if it is plugged with its through openings (31) onto the bolts (32), wherein the adapter element (18) comprises through openings extending perpendicular to a longitudinal axis of the adapter element (18) between the top side (20) and the bottom side (19), and
- wherein a lower end of each of the bolts (32) projects into one of the respective through openings of the adapter element (18) and is secured in the respective through opening by a respective nut (33).

2. The sealing system (10) according to claim 1,
wherein the bottom side (19) of the adapter element (18) is adapted to the upper end surface (2) of the dummy bar head (1) and can be fastened to the upper end surface (2) of the dummy bar head (1) by first fastening means (22).

3. The sealing system (10) according to claim 2,
wherein the first fastening means (22) are designed to be positive-locking.

4. The sealing system (10) according to claim 3,
wherein the first fastening means (22) have at least one connecting bar (24), which has a bulge (25) or hook at its free end, and at least one recess (26), wherein the bulge (25) or hook of the connecting bar (24) and the recess can be brought into engagement with one another.

5. The sealing system (10) according to claim 4,
wherein the connecting bar (24) has a mushroom-shaped bulge (25) and the recess (26) comprises a widened region (27) and the mushroom-shaped bulge (25) and the widened region (27) of the recess (26) are formed complementary to one another.

6. The sealing system (10) according to claim 5,
wherein the recess (26) has a narrow bottleneck-like section (28) that, starting from the upper end surface (2) of the dummy bar head (1), leads into the widened region (27) of the recess (26).

7. The sealing system (10) according to claim 4,
wherein the connecting bar (24) is attached to a bottom side (19) of the adapter element (18) and the recess (26)

is formed in the dummy bar head (1) adjacent to its upper end surface (2) and opens into this end surface (2).

8. The sealing system (10) according to claim 4, wherein the recess (26) is open on at least one side surface of the dummy bar head (1), such that the connecting bar with its bulge (25) can be introduced into the recess (26) from this side surface.

9. The sealing system (10) according to claim 1, wherein the head element (12) and the adapter element (18) in each case have a rectangular cross-section with a longitudinal side (L) and a short side (K) in a plane running orthogonally to a transport direction of the dummy bar head (1), wherein a longitudinal extent of the longitudinal side (L) is greater by a multiple amount than a longitudinal extent of the short side (K).

10. The sealing system (10) according to claim 9, wherein the head element (12) and the adapter element (18) are in each case adapted to a cross-section of a mold (3) of a continuous casting plant with their cross-section in the plane orthogonal to the transport direction of the dummy bar head (1).

11. The sealing system according to claim 9, wherein a short side (K) of the rectangular cross-section of the adapter element (18) or of the head element (12) has a length of at least 100 mm.

12. The sealing system (10) according to claim 1, wherein a plurality of elevations (16) are formed on a top side (15) of the head element (12).

13. The sealing system (10) according to claim 12, wherein each elevation (16) has a cross-shaped geometry in plan view, formed by intersecting portions extending upward from the top side (15) of the head element (12) so as to provide a maximized contact surface for bonding with molten steel.

14. The sealing system (10) according to claim 1, wherein the peripheral seal (14) is made from plastic.

15. The sealing system (10) according to claim 14, wherein external dimensions of the peripheral seal (14) are slightly larger than a cross-section of a mold (3) of a continuous casting plant in a plane orthogonal to a transport direction of the dummy bar head (1).

16. The sealing system (10) according to claim 1, wherein the peripheral seal (14) is made of plastic and molded onto an edge of the head element (12).

17. A method for producing a metallic product by continuous casting, comprising:

introducing the sealing system according to claim 12 into a mold of a continuous casting plant; and filling molten metal into the mold and causing the molten metal to undergo sufficient cooling by contact with the top side (15) of the head element (12) and the elevations (16) provided there, wherein the method is carried out without using cooling scrap.

* * * * *